US011783752B2

(12) United States Patent
Kim et al.

(10) Patent No.: US 11,783,752 B2
(45) Date of Patent: Oct. 10, 2023

(54) GAMMA LOOKUP TABLE COMPRESSION

(71) Applicant: Google LLC, Mountain View, CA (US)

(72) Inventors: Hyunchul Kim, San Jose, CA (US); Sun-il Chang, San Jose, CA (US); Wonjae Choi, San Jose, CA (US); Sang Young Youn, Cupertino, CA (US)

(73) Assignee: Google LLC, Mountain View, CA (US)

( * ) Notice: Subject to any disclaimer, the term of this patent is extended or adjusted under 35 U.S.C. 154(b) by 0 days.

(21) Appl. No.: 17/615,992

(22) PCT Filed: Dec. 17, 2019

(86) PCT No.: PCT/US2019/066859

§ 371 (c)(1),
(2) Date: Dec. 2, 2021

(87) PCT Pub. No.: WO2021/126169

PCT Pub. Date: Jun. 24, 2021

(65) Prior Publication Data

US 2022/0319382 A1 Oct. 6, 2022

(51) Int. Cl.

*G09G 3/20* (2006.01)
*G09G 5/00* (2006.01)

(52) U.S. Cl.

CPC ..... *G09G 3/2074* (2013.01); *G09G 5/005* (2013.01); *G09G 2320/0276* (2013.01); *G09G 2320/0285* (2013.01); *G09G 2320/0673* (2013.01)

(58) Field of Classification Search

CPC ... G09G 2320/0673; G09G 2320/0276; G09G 5/005; G09G 2320/0285; G09G 3/2074

See application file for complete search history.

(56) References Cited

U.S. PATENT DOCUMENTS

| | | | | |
|---|---|---|---|---|
| 2008/0239157 | A1 | 10/2008 | Rai | |
| 2018/0114495 | A1* | 4/2018 | Jung | G09G 3/3607 |
| 2019/0027082 | A1* | 1/2019 | Van Belle | G09G 3/2003 |
| 2019/0114963 | A1 | 4/2019 | Choi et al. | |
| 2019/0156786 | A1 | 5/2019 | Aogaki et al. | |
| 2019/0180695 | A1 | 6/2019 | Ha et al. | |

OTHER PUBLICATIONS

International Preliminary Report on Patentability in International Appln. No. PCT/US2019/066859, dated Jun. 30, 2022, 10 pages.
International Search Report and Written Opinion in International Appln. No. PCT/US2019/066859, dated May 15, 2020, 12 pages.

* cited by examiner

*Primary Examiner* — Abbas I Abdulselam
(74) *Attorney, Agent, or Firm* — Fish & Richardson P.C.

(57) ABSTRACT

Methods, systems, and apparatus, including computer programs encoded on a computer storage medium, for gamma lookup table compression. In one aspect, a method includes obtaining a gamma value for a pixel of an image to be shown on a display, determining a base gamma value based on a base lookup table that corresponds to a base display condition, determining a delta gamma value based on a delta lookup table that corresponds to a current display condition for the pixel, determining a remapped gamma value for the pixel based on a combination of the base gamma value and the delta gamma value, and providing the remapped gamma value to be shown on the display.

16 Claims, 6 Drawing Sheets

GAMMA LOOKUP TABLE COMPRESSION

CROSS-REFERENCE TO RELATED APPLICATIONS

This application is a National Stage Application under 35 U.S.C. § 371 and claims the benefit of International Application No. PCT/US2019/066859, filed on Dec. 17, 2019. The disclosure of the prior application is considered part of and is incorporated by reference in the disclosure of this application.

BACKGROUND

Gamma correction may be performed when showing an image on a display. For example, values of pixels in the image may be gamma corrected and the gamma corrected values may then be used to display the image. Gamma correction may be used so that an image is accurately shown. For example, gamma correction may account for variations in performance of different displays due to differences in physical structures of pixels across displays.

SUMMARY

This specification describes techniques, methods, systems, and other mechanisms for gamma lookup table compression. Gamma lookup tables may be used so that images are accurately displayed on the displays. For example, gamma lookup tables may remap a gamma value of G50 for a pixel in an image to G48 so that the display accurately shows that pixel of the image. In another example, the gamma lookup tables may remap a gamma value of G51 for a pixel in an image to G52 so that the display accurately shows that pixel of the image.

Gamma lookup tables may be unique to each display. A first display may have a gamma lookup table with output values that are different than a second display due to differences in how pixels in each display respond to driving current. For example, a gamma lookup table for a first display may remap G50 to G45 and a gamma lookup table for a second display may remap G50 to G48.

Displays may have many gamma lookup tables for performing gamma correction. For example, an organic light emitting diode (OLED) display may operate at two different refresh rates and seven display brightness values (DBV) so store forty two gamma lookup tables (three for each of red, green, and blue multiplied by two for each frequency multiplied by seven for each DBV).

The DBV may correspond to different ranges of brightness for a display. For example, a display brightness between 0-13% for an entire display may correspond to a DBV of 0 (also referred to as DBV 0), a display brightness between 14-26% for an entire display may correspond to DBV 1, a display brightness between 27-41% for an entire display may correspond to DBV 2, etc. In another example, DBV for a display may be split into three different ranges where DBV 0 corresponds to 0-33% brightness for an entire display, DBV 1 corresponds to 34-66%, and DBV 2 corresponds to 67-100%.

As the number of refresh rates and DBV for a display increases so may a number of gamma lookup tables that are stored for the display. Additionally, some displays may include areas with different pixel densities. For example, a display may include a top portion of the display with a pixel density that is half that of a bottom portion of the display. The areas with different pixel densities may each behave differently from one another. For example, the area with lower pixel density may show gamma values less bright than the area with higher pixel density, so the area with lower pixel density may use a gamma table that remaps gamma values higher than a gamma table used by the higher pixel density area.

Accordingly, a display that includes areas with two different pixel densities and operates at three different refresh rates and seven DGV may store one hundred twenty six gamma lookup tables (three for each of red, green, and blue multiplied by three for each frequency multiplied by seven for each DGV multiplied by two for the different pixel densities).

However, increasing a number of gamma lookup tables that are stored may increase an amount of memory resources needed to store the gamma lookup tables. For example, doubling the number of gamma lookup tables may double the amount of physical memory needed to store the gamma lookup tables. Increasing the amount of memory resources may increase a physical size of memory and increase costs from the memory itself.

Gamma lookup table compression may address problems from having displays, one or more of, include areas with different pixel densities, operate at more refresh rates, or operate at more DBV. Generally, gamma lookup tables may slightly vary across different refresh rates and different DBV. For example, a gamma lookup table for a 60 hertz (Hz) refresh rate and DBV 0 may have output values that are very slightly above output values for a gamma lookup table for a 90 Hz refresh rate and DBV 0.

Accordingly, a system that uses gamma lookup table compression may store a base lookup table for a particular combination of refresh rate and DBV, and store delta lookup tables for each other combination of refresh rate and DBV where the delta lookup tables represent a difference for the combination of refresh rate and DBV from the base lookup table. For example, where there are twenty one combinations of refresh rate and DBV, the system may store a single base gamma lookup table and twenty delta gamma lookup tables.

Storing a delta gamma lookup table instead of a non-delta gamma lookup table may be advantageous in that each delta gamma lookup table may require less memory than a non-delta gamma lookup table. For example, as the maximum value of outputs of the delta gamma lookup tables may be smaller than the maximum value of outputs of the base gamma lookup table, the base gamma lookup table may store outputs with ten bits and the delta gamma lookup tables may store outputs with five bits. Accordingly, using gamma lookup table compression may reduce an amount of memory used for gamma correction.

Additionally, increasing a number of gamma lookup tables may increase a time needed to generate values for the gamma lookup tables. For example, each gamma lookup table may be generated by testing a display at a factory to see how the display responds to a driving current while at the refresh rate and the DBV that corresponds to the gamma lookup table. A system that uses gamma lookup table compression may take more measurements of a display's response to driving current at a refresh rate and DBV that corresponds to a base gamma lookup table than at refresh rates and DBVs that correspond to delta gamma lookup tables, and then generate output values for the base gamma lookup table and the delta gamma lookup tables from the measurements.

In general, one innovative aspect of the subject matter described in this specification can be embodied in a method that obtaining a gamma value for a pixel of an image to be shown on a display, determining a base gamma value based on a base lookup table that corresponds to a base display condition, determining a delta gamma value based on a delta lookup table that corresponds to a current display condition for the pixel, determining a remapped gamma value for the pixel based on a combination of the base gamma value and the delta gamma value, and providing the remapped gamma value to be shown on the display.

Other embodiments of this aspect include corresponding circuitry, computer systems, apparatus, and computer programs recorded on one or more computer storage devices, each configured to perform the actions of the methods. A system of one or more computers can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions.

These and other embodiments can each optionally include one or more of the following features. In some aspects, determining a remapped gamma value for the pixel based on a combination of the base gamma value and the delta gamma value includes determining a sum of the base gamma value and the delta gamma value as the remapped value. In certain aspects, determining a delta gamma value based on a delta lookup table that corresponds to a current display condition for the pixel includes determining the current display condition, determining delta gamma values for delta lookup tables that each correspond to a different display condition, and selecting the delta gamma value from the set of delta gamma values based on the current display condition.

In some implementations, selecting the delta gamma value from the set of delta gamma values based on the current display condition includes providing a selection signal to a multiplexor that receives the delta gamma values as inputs and uses the selection signal to select the delta gamma value as an output. In certain aspects, determining the current display condition includes determining a refresh rate of the display and display brightness value of the display, where the delta lookup tables each correspond to a different combination of refresh rate of the display and display brightness value of the display.

In some aspects, the base gamma value is represented by more bits than the delta gamma value. In some implementations, the base gamma value is represented by ten bits and the delta gamma value is represented by five bits. In certain aspects, the base lookup table represents outputs of base gamma values with more bits than the delta lookup table represents outputs of delta gamma values.

The details of one or more embodiments of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1A:
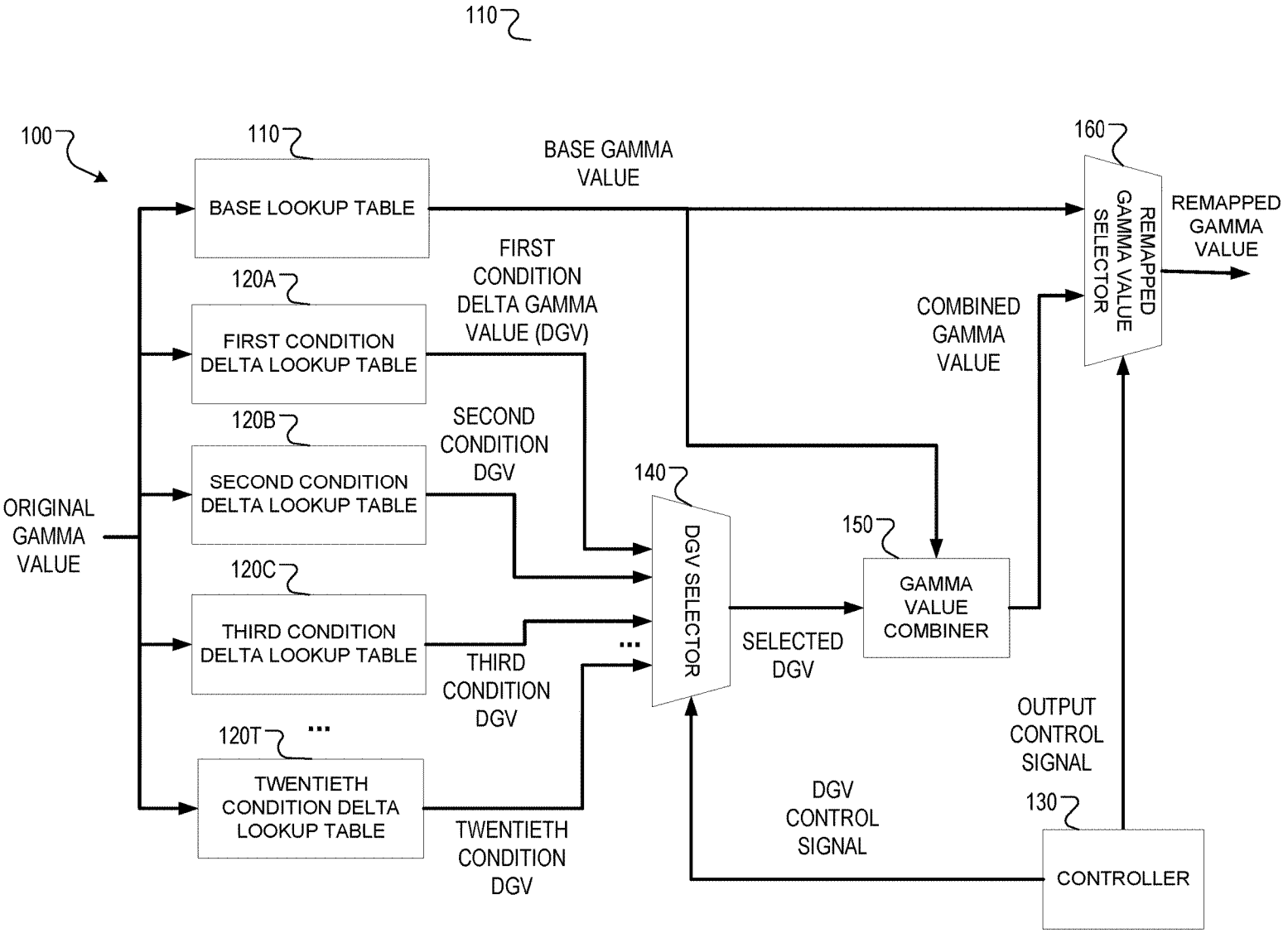
FIGS. 1A-1E are block diagrams of an example system with gamma lookup table compression.

FIGS. 1A-1E are block diagrams of an example system 100 with gamma lookup table compression. The system 100 includes a base lookup table 110, a set of delta lookup tables 120A-T (hereinafter collectively referred to as 120) for different conditions, a controller 130, a delta gamma value selector 140, a gamma value combiner 150, and an remapped gamma value selector 160.

The base lookup table 110 may be a gamma lookup table for a base display condition. For example, the base lookup table 110 may be a gamma lookup table for a base condition of a refresh rate of 60 Hz and DBV 0. The base lookup table 110 may include pairs of each possible value of input and a corresponding output for that value of input. For example, where a gamma value of a pixel in an image is an integer that ranges between zero to two hundred fifty five, the base lookup table 110 may include two hundred fifty six pairs, where each pair includes a different input value between zero to two hundred fifty six and an output value that corresponds to the input value.

The delta lookup tables 120 may each correspond to a different display condition. For example, where a display operates in three different refresh rates and seven different DBV, there may be twenty different display conditions besides the base display condition and there may be a delta lookup table for each of the twenty different display conditions.

Similarly to the base lookup table 110, each of the delta lookup tables 120 may include a paired input value and output value. For example, each of the delta lookup tables 120 may include two hundred fifty six pairs, where each pair includes a different input value that is an integer between zero to two hundred fifty six and an output value that corresponds to the input value. The output values for the same input value may differ across the delta lookup tables 120 as a display may operate differently between different conditions. For example, for the same driving current, a display may emit light brighter at 120 Hz and DBV 0 than at 90 Hz and DBV 0 so the outputs values for the delta lookup tables for those two conditions may be different for the same input value.

Additionally, the delta lookup tables 120 and the base lookup table 110 are different in that the output values of the delta lookup tables 120 are represented with less memory than the output values of the base lookup table 110. For example, each of the delta lookup tables 120 may be stored with about 50% of the bits used to store the base lookup table 110.

The delta lookup tables 120 may be stored with less memory than the base lookup table 110 as the maximum output value stored by the base lookup table 110 may be smaller than the maximum output value stored by the delta lookup tables 120. For example, a maximum output value of the base lookup table 110 may be represented by ten bits so the base lookup table 110 may be stored with ten bits for each output value for each entry, and the maximum output value of the delta lookup tables 120 may be represented by five bits so the delta lookup tables 120 may be stored with five bits for each output value for each entry.

The controller 130 may determine a current display condition and then provide corresponding control signals to the DGV selector 140 and the remapped gamma value selector 160. For example, the controller 130 may determine that a current display condition is a refresh rate of 120 Hz and DBV 6 and, in response, provide a control signal to the DGV selector 140 that causes the DGV selector 140 to select the output from the delta lookup table 120T as the output from the DGV selector 140 and provide a control signal to the remapped gamma value selector 160 that causes the remapped gamma value selector 160 to select the output from the gamma value selector 150 as the output from the remapped gamma value selector 160.

The DGV selector 140 may receive outputs from the delta lookup tables 120 and select one of the outputs as an output from the DGV selector 140. For example, the DGV selector 140 may receive a gamma value output of G-1.1 from the delta lookup table 120T, select that output, and then output the gamma value of G-1.1 that was selected.

The DGV selector 140 may select an output from the delta lookup tables 120 based on a control signal from the controller 130. For example, the DGV selector 140 may be a multiplexor where the inputs to the multiplexor are the outputs of the delta lookup tables 120, and the selection pins of the multiplexor receive the control signal from the controller 130. In the example, the controller 130 may determine the current display condition, then identify the input to the multiplexor that corresponds to the delta lookup table of the current display condition, and then output the control signal value that causes the multiplexor to select that input that was identified.

The gamma value combiner 150 may receive the output from the DGV selector 140 and the output from the base lookup table 110, and determine a combined gamma value based on the two outputs. For example, the gamma value combiner 150 may receive G80.25 from the base lookup table 110 and G-1.1 from the DGV selector 140 and determine a combined gamma value of G79.15.

The gamma value combiner 150 may determine the combined gamma value based on summing the two outputs that the combiner 150 receives. For example, the combiner 150 may sum G80.25 from the base lookup table 110 and G-1.1 from the DGV selector 140 to determine G79.15 and use that as the combined gamma value.

The remapped gamma value selector 160 may receive the output from the base lookup table 110 and the output from the DGV selector 140 and select one of the outputs as the remapped gamma value. For example, the remapped gamma value selector 160 may receive a gamma value output of G80.25 from the base lookup table 110 and a combined gamma value of G79.15, and select G79.15 as the remapped gamma value.

The remapped gamma value selector 160 may select an output based on a control signal from the controller 130. For example, the remapped gamma value selector 160 may be a multiplexor where the inputs to the multiplexor are the outputs from the base lookup table 110 and the gamma value combiner 150, and the selection pins of the multiplexor receive the control signal from the controller 130.

In the example, the controller 130 may determine whether the current display condition is the base condition and if the current display condition is the base display condition, output a control signal of zero that causes the multiplexor to select the first input which is an output of the base lookup table 110 and, if not, output a control signal of one that causes the multiplexor to select the second input which is an output of the gamma value combiner 150.

Figure 1B:
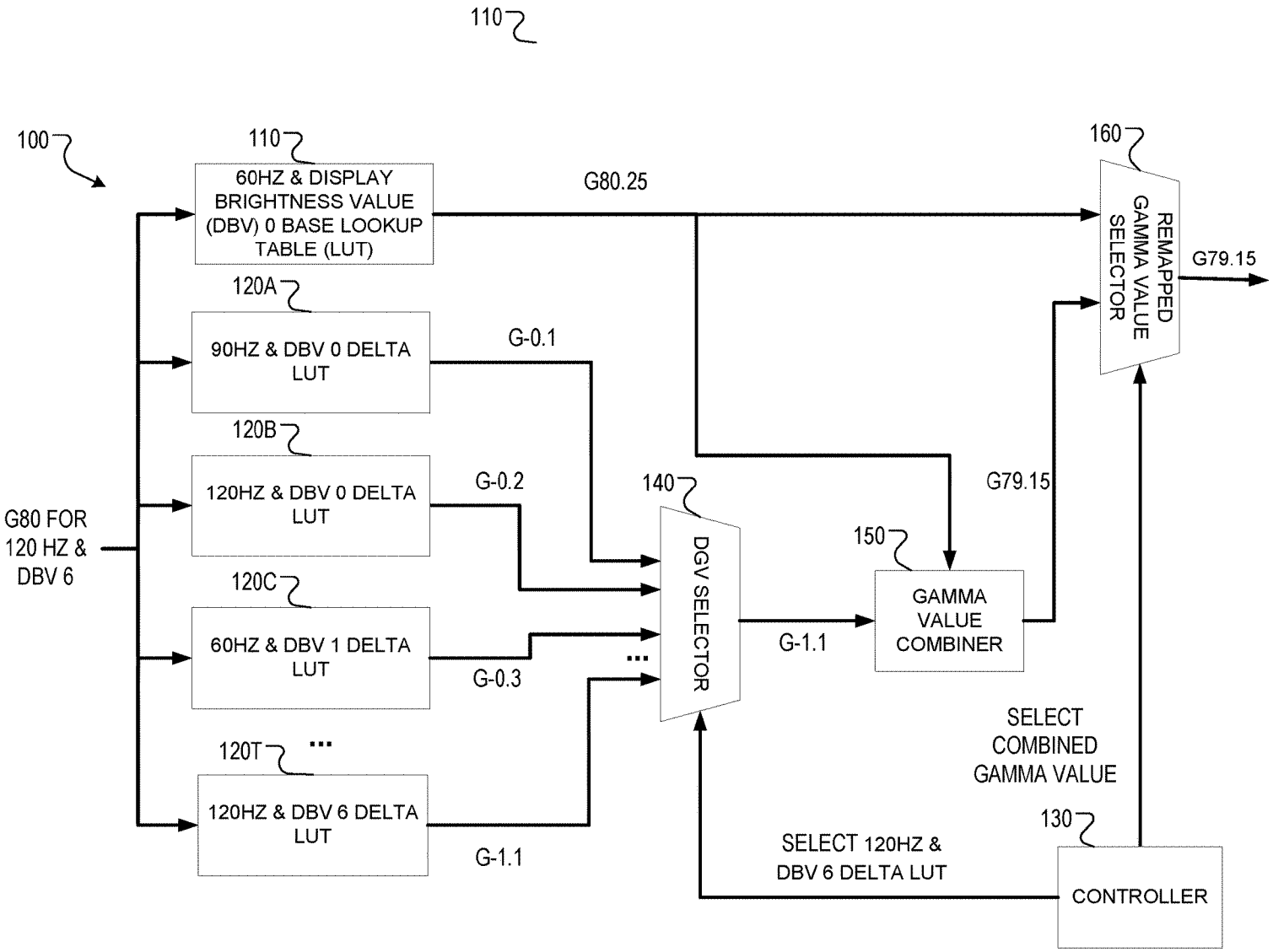
Figure 1C:
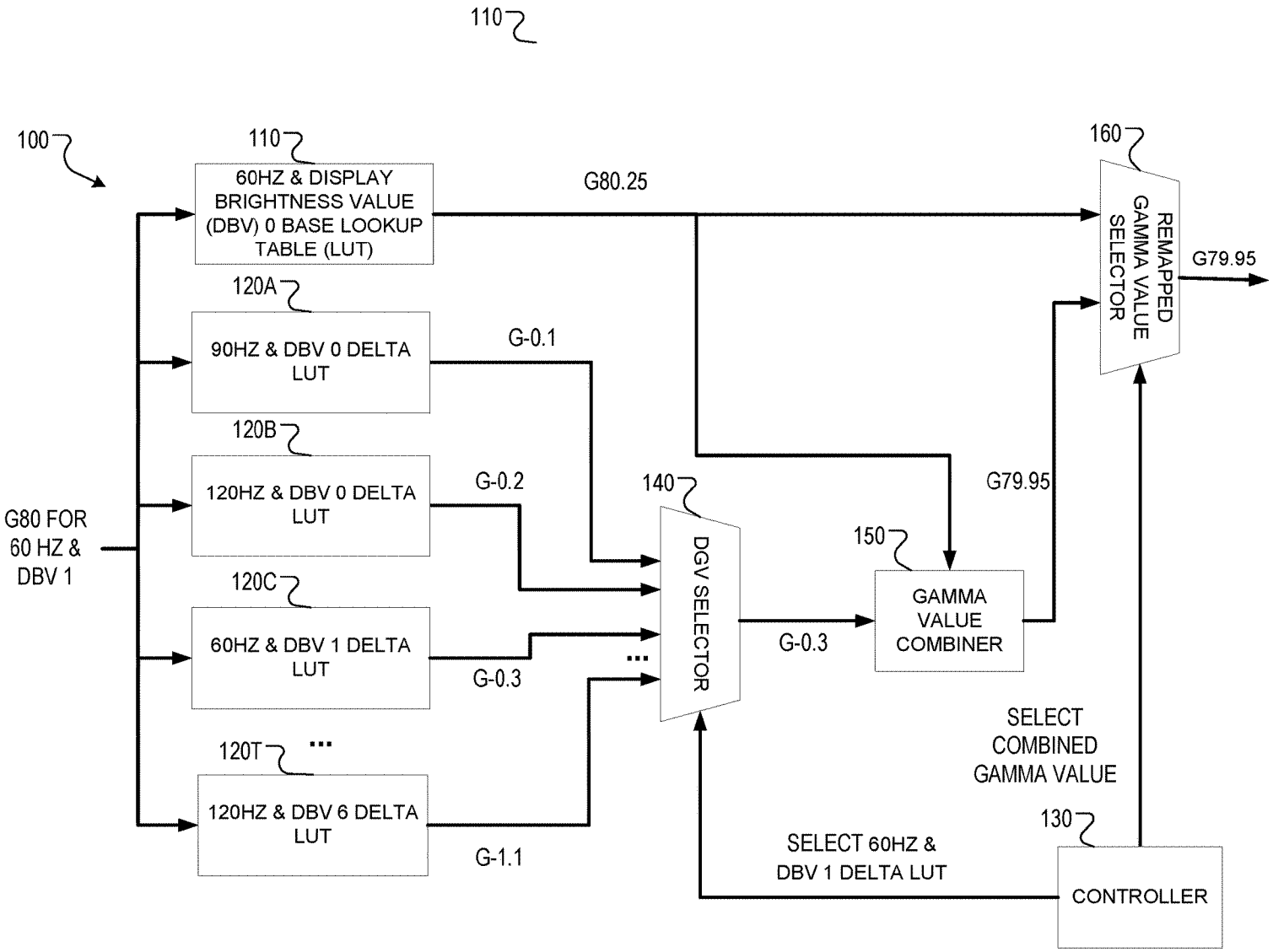

FIG. 1B shows one example where a pixel with a gamma value of G80 is to be displayed with a current display condition of 120 Hz and DBV 6. As shown, the base lookup table 110 receives G80 and outputs G80.25, the delta lookup table 120A for 90 Hz and DBV 0 receives G80 and outputs G-0.1, the delta lookup table 120B for 120 Hz and DBV 0 receives G80 and outputs G-0.2, the delta lookup table 120C for 60 Hz and DBV 1 receives G80 and outputs G-0.3, and the delta lookup table 120T for 120 Hz and DBV 6 receives G80 and outputs G-1.1. While not shown, delta lookup tables for the other combinations of refresh rate and DBV also receive G80 and output corresponding delta gamma values.

The controller 130 determines that the current display condition is 120 Hz and DBV 6 and, in response, outputs a control signal of nineteen to the DGV selector 140 and a control signal of one to the remapped gamma value selector 160. The DGV selector 140 receives all the outputs from the delta lookup tables 120 and the control signal of nineteen, and selects the twentieth input which corresponds to the output of G-1.1 from the delta lookup table 120T for 120 Hz and DBV 6.

The gamma value combiner 150 receives the output of G80.25 from the base lookup table 110 and G-1.1 from the DGV selector, sums the values as G79.15, and then outputs the value of G79.15 to the remapped gamma value selector 160. The remapped gamma value selector 160 receives G80.25 from the base lookup table 110, G79.15 from the gamma value combiner 150, and a control signal of one from the controller 130, and, in response, selects the second input which corresponds to G79.15 and outputs the selected value of G79.15 as the remapped gamma value.

FIG. 10 shows another example where a pixel with a gamma value of G80 is to be displayed with a current display condition of 60 Hz and DBV 1. As shown, the base lookup table 110 and delta lookup tables 120 receive and output the same values as in FIG. 1B.

The controller 130 determines that the current display condition is 60 Hz and DBV 1 and, in response, outputs a control signal of two to the DGV selector 140 and a control signal of one to the remapped gamma value selector 160. The DGV selector 140 receives all the outputs from the delta lookup tables 120 and the control signal of two, and selects the third input which corresponds to the output of G-0.3 from the delta lookup table 120C for 60 Hz and DBV 1.

The gamma value combiner 150 receives the output of G80.25 from the base lookup table 110 and G-0.3 from the DGV selector 140, sums the values as G79.95 and then outputs the value of G79.95 to the remapped gamma value selector 160. The remapped gamma value selector 160 receives G80.25 from the base lookup table 110, G79.95 from the gamma value combiner 150, and a control signal of one from the controller 130, and selects the second input which corresponds to G79.95 and outputs the selected value of G79.95 as the remapped gamma value.

Figure 1D:
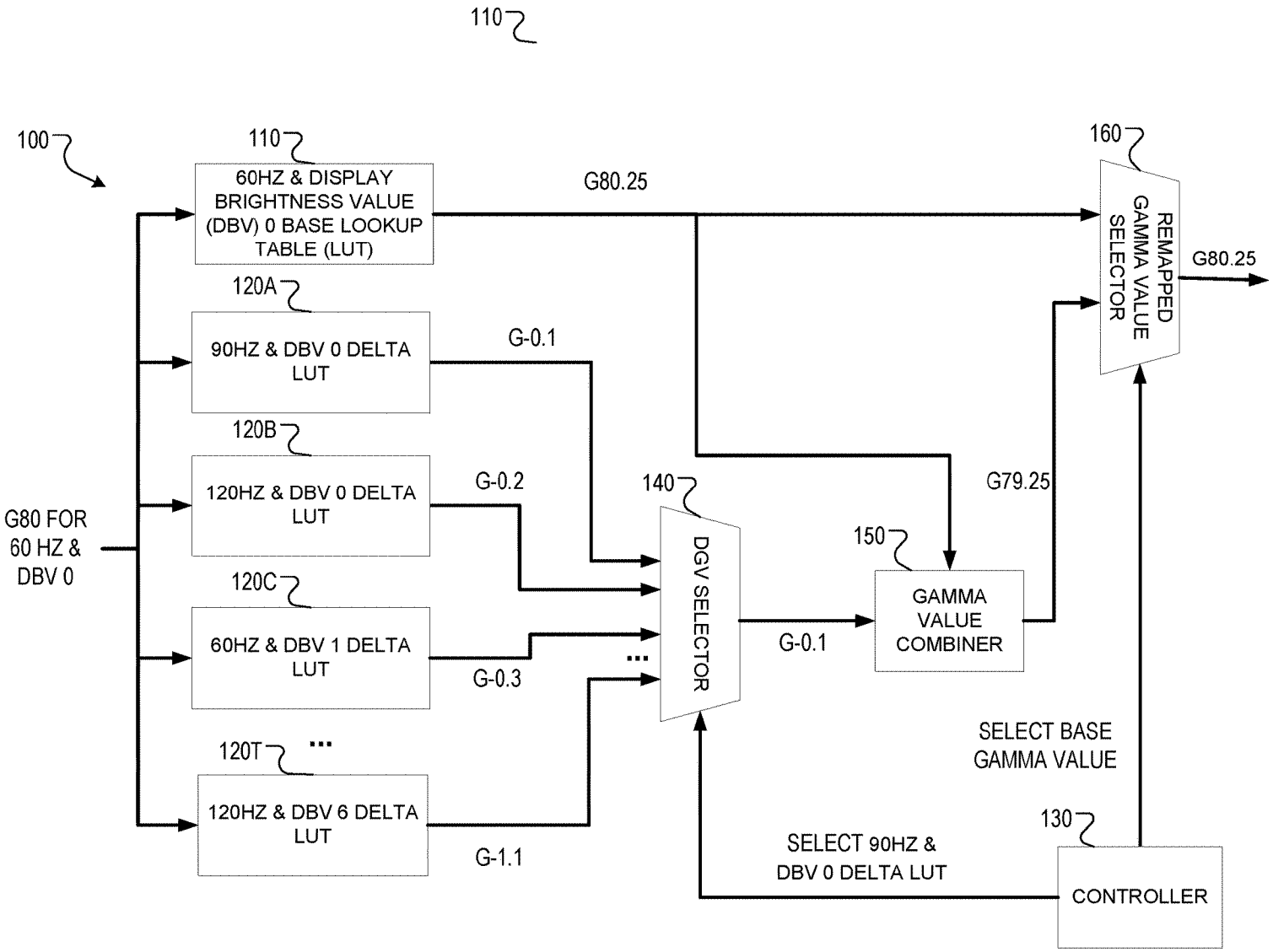

FIG. 1D shows another example where a pixel with a gamma value of G80 is to be displayed with a current display condition of 60 Hz and DBV 0, which is also the base display condition. As shown, the base lookup table 110 and delta lookup tables 120 receive and output the same values as in FIG. 1B.

The controller 130 determines that the current display condition is 60 Hz and DBV 0 and, in response, outputs a control signal with an arbitrary value of zero to the DGV selector 140 and a control signal of zero to the remapped gamma value selector 160. The DGV selector 140 receives all the outputs from the delta lookup tables 120 and the control signal of zero, and, in response, selects the first input which corresponds to the output of G-0.1 from the delta lookup table 120A for 90 Hz and DBV 0.

The gamma value combiner 150 receives the output of G80.25 from the base lookup table 110 and G-0.1 from the DGV selector 140, sums the values as G79.25 and then outputs the value of G79.25 to the remapped gamma value selector 160. The remapped gamma value selector 160 receives G80.25 from the base lookup table 110, G79.25 from the gamma value combiner 150, and a control signal of zero from the controller 130, and selects the first input which corresponds to 80.25 and outputs the selected value of G80.25 as the remapped gamma value.

Figure 1E:
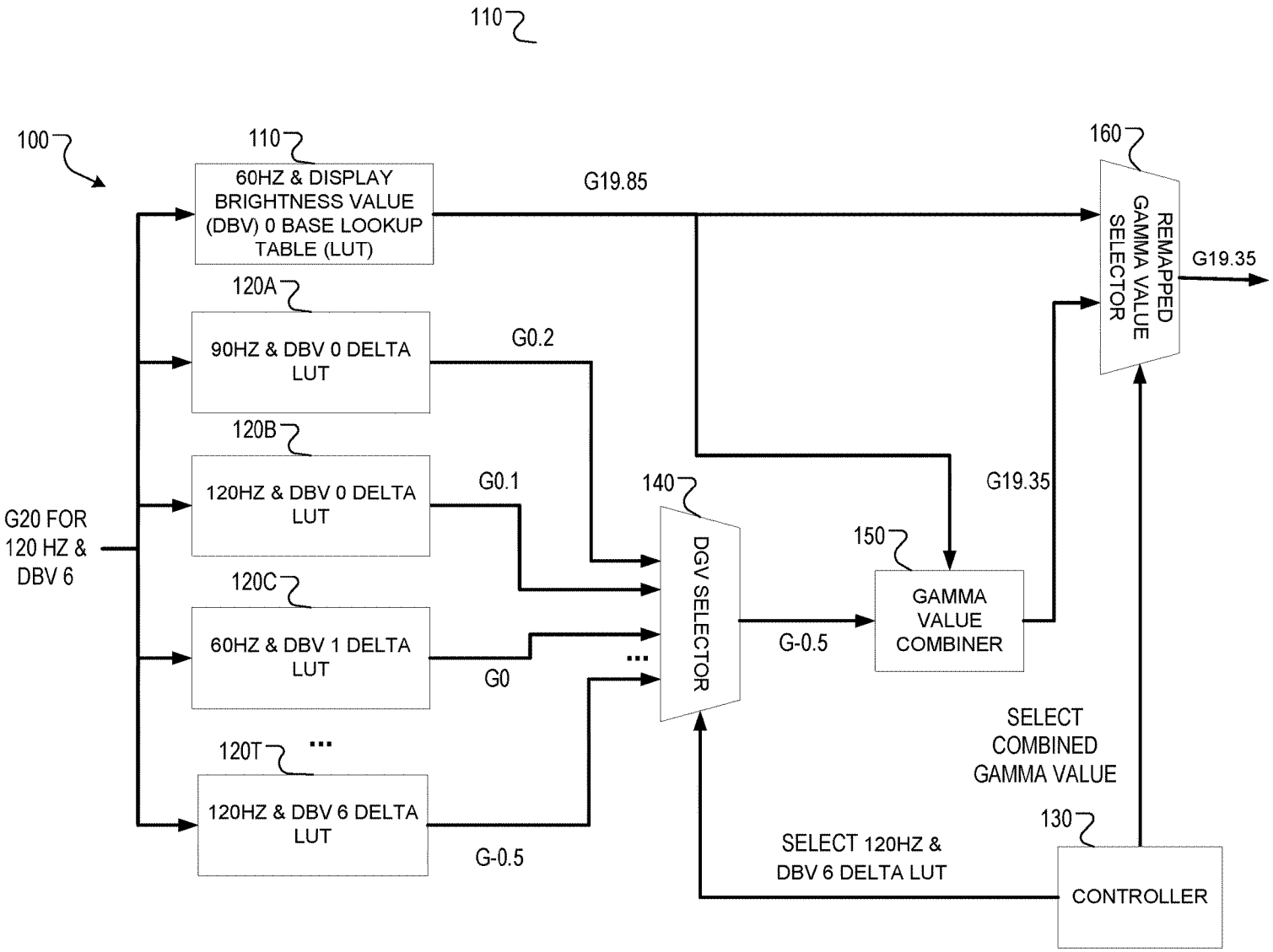

FIG. 1E shows another example where a pixel with a gamma value of G20 is to be displayed with a current display condition of 120 Hz and DBV 6. As the inputs into the base lookup table 110 and the delta lookup tables 120 are different, the outputs from the lookup table are different. However, the control signal from the controller 130 are similar to as shown in FIG. 1B because both have the same current display condition.

Accordingly, the DGV selector 140 selects delta gamma value of G-0.5 from the delta lookup table 120T, the gamma value combiner 150 combines a base gamma value of G19.85 from the base lookup table 110 with the selected delta gamma value of G-0.5, and outputs a sum of G19.35, and the remapped gamma value selector 160 selects the sum of G19.35 as the remapped gamma value.

The operations described above for the base lookup table 110, the set of delta lookup tables 120, the controller 130, the DGV selector 140, the gamma value combiner 150, and the remapped gamma value selector 160 may be performed for each pixel in the image. For example, the operations described above may be performed sequentially first for a pixel at location 0,0, then a pixel at location 0,1, then a pixel at location 0,2, etc. until values specified for pixels in the image are remapped. In another example, the operations described above may be performed in parallel for a pixel at location 0,0, a pixel at location 0,1, a pixel at location 0,2, etc. for all locations of pixels in the image. The operations may be performed for each type of color. For example, a remapped gamma value may be determined for a red value of a pixel, then for a blue value of the pixel, and then for a green value of the pixel.

The remapped gamma value that is output from the system 100 may then be provided to driver integrated circuit that is configured to receive remapped values and provide voltage to pixels in a display. For example, the remapped value of G79.15 may result in a voltage of 1.5 volts being provided to a pixel in the display panel and remapped value of G19.35 may result in a voltage of 0.8 volts being provided to a pixel in the display panel. The driver integrated circuit may receive other control factors that affect the final voltage output based on a remapped value, such control factors including display brightness control, display uniformity calibration, color calibration, and pattern loading effect control.

Figure 2:
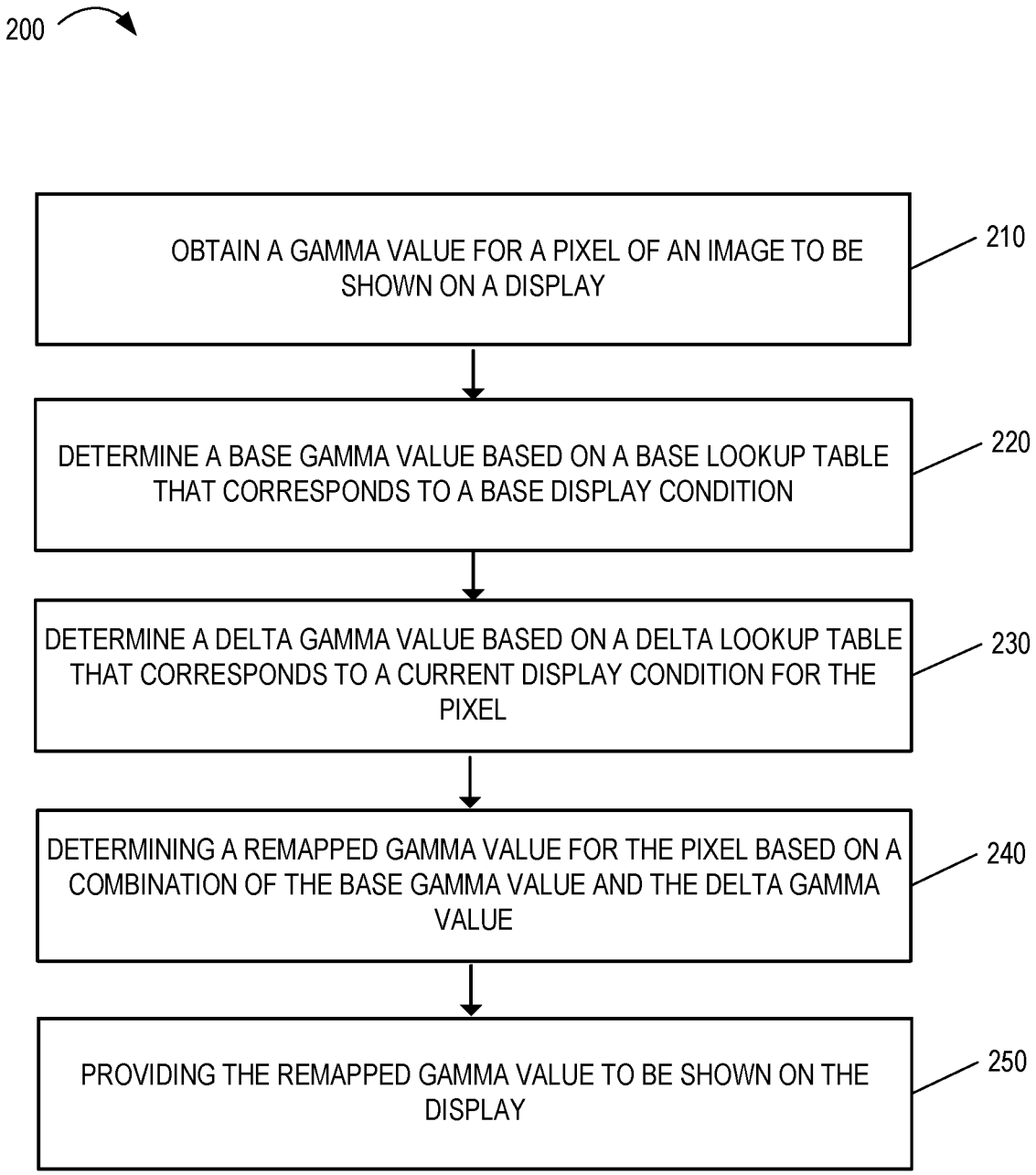
FIG. 2 is a flowchart that shows a process for remapping with compressed gamma lookup tables.

FIG. 2 is a flowchart that shows a process 200 for remapping with compressed gamma lookup tables. The process 200 may be performed by the system 100. The process 200 includes obtaining a gamma value for a pixel of an image to be shown on a display (210). For example, the system 100 may receive an image to be displayed with a gamma value of G80 for a red color of a particular pixel.

The process 200 includes determining a base gamma value based on a base lookup table that corresponds to a base display condition (220). For example, the base lookup table 110 may receive the gamma value of G80 and output a base gamma value of G80.25.

The process 200 includes determining a delta gamma value based on a delta lookup table that corresponds to a current display condition for the pixel (230). For example, the current display condition may be 120 Hz and DBV 6 and the delta lookup table 120T for the display condition of 120 Hz and DBV 6 may receive the gamma value of G80 and output a delta gamma value of G-1.1.

In some implementations, determining a delta gamma value based on a delta lookup table that corresponds to a current display condition for the pixel includes determining the current display condition, determining delta gamma values for delta lookup tables that each correspond to a different display condition, and selecting the delta gamma value from the set of delta gamma values based on the current display condition.

For example, delta lookup tables 120 may receive the gamma value of G80 for the pixel and output corresponding delta gamma values, the controller 130 may determine that a current display condition is 120 Hz and DBV 6 and output a control signal that instructs the DGV selector 140 to select the delta gamma value from the delta lookup table 120T for 120 Hz and DBV 6 as the delta gamma value, and the DGV selector 140 may receive all the delta gamma values output from the delta lookup tables 120 and the control signal, and, in response, select the output of the delta lookup table 120T for 120 Hz and DBV 6 as the delta gamma value.

In some implementations, selecting the delta gamma value from the set of delta gamma values based on the current display condition includes providing a selection signal to a multiplexor that receives the delta gamma values as inputs and uses the selection signal to select the delta gamma value as an output. For example, the DGV selector 140 may be a multiplexor that receives the delta gamma values output from the delta lookup tables 120 as inputs and the control signal from the controller 130 as a selecting signal.

In some implementations, determining the current display condition includes determining a refresh rate of the display and display brightness value of the display, where the delta lookup tables each correspond to a different combination of refresh rate of the display and display brightness value of the display. For example, the display may operate at three different refresh rates and seven different DBV so there may be one base lookup table for 60 Hz and DBV 0, and twenty delta lookup tables for the other twenty different combinations of refresh rate and DBV.

The process 200 includes determining a remapped gamma value for the pixel based on a combination of the base gamma value and the delta gamma value (240). For example, the gamma value combiner 150 may receive the base gamma value of G80.25 and the delta gamma value of G-1.1, and determine a combined gamma value of G79.15, and the remapped gamma value selector 160 may then select the combined gamma value as the remapped gamma value.

In some implementations, determining a remapped gamma value for the pixel based on a combination of the base gamma value and the delta gamma value includes determining a sum of the base gamma value and the delta gamma value as the remapped value. For example, the gamma value combiner 150 may determine the combined gamma value of G79.15 by summing the base gamma value of G80.25 and the delta gamma value of G-1.1.

The process 200 includes providing the remapped gamma value to be shown on the display (250). For example, the system 100 may provide the remapped gamma value of G79.15 to a driver integrated circuit to drive a display under the current display conditions.

In some implementations, the base gamma value is represented by more bits than the delta gamma value. For example, the base gamma value may be represented by ten bits and the delta gamma value may be represented by five bits. Similarly, the outputs of the base lookup table 110 may be represented by ten bits and the outputs of the delta lookup tables 120 may be represented by five bits.

Embodiments of the subject matter and the operations described in this specification can be implemented in digital electronic circuitry, or in computer software, firmware, or hardware, including the structures disclosed in this specification and their structural equivalents, or in combinations of one or more of them. Embodiments of the subject matter described in this specification can be implemented as one or more computer programs, i.e., one or more modules of computer program instructions, encoded on computer storage medium for execution by, or to control the operation of, data processing apparatus.

A computer storage medium can be, or be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially-generated propagated signal. The computer storage medium can also be, or be included in, one or more separate physical components or media (e.g., multiple CDs, disks, or other storage devices).

The operations described in this specification can be implemented as operations performed by a data processing apparatus on data stored on one or more computer-readable storage devices or received from other sources.

The term "data processing apparatus" encompasses all kinds of apparatus, devices, and machines for processing data, including by way of example a programmable processor, a computer, a system on a chip, or multiple ones, or combinations, of the foregoing. The apparatus can include special purpose logic circuitry, e.g., an FPGA (field programmable gate array) or an ASIC (application-specific integrated circuit). The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages, and it can be deployed in any form, including as a stand-alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform actions by operating on input data and generating output. The processes and logic flows can also be performed by, and apparatus can also be implemented as, special purpose logic circuitry, e.g., a FPGA (field programmable gate array) or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for performing actions in accordance with instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device (e.g., a universal serial bus (USB) flash drive), to name just a few. Devices suitable for storing computer program instructions and data include all forms of non-volatile memory, media and memory devices, including by way of example semiconductor memory devices, e.g., EPROM (erasable programmable read-only memory), EEPROM (electrically erasable programmable read-only memory), and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, embodiments of the subject matter described in this specification can be implemented on a computer having a display device, e.g., a CRT (cathode ray tube), LCD (liquid crystal display) or OLED (organic light emitting diode) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's user device in response to requests received from the web browser.

Embodiments of the subject matter described in this specification can be implemented in a computing system that includes a back-end component, e.g., as a data server, or that includes a middleware component, e.g., an application server, or that includes a front-end component, e.g., a user computer having a graphical user interface or a Web browser through which a user can interact with an implementation of the subject matter described in this specification, or any combination of one or more such back-end, middleware, or front-end components. The components of the system can be interconnected by any form or medium of digital data communication, e.g., a communication network. Examples of communication networks include a local area network ("LAN") and a wide area network ("WAN"), an inter-network (e.g., the Internet), and peer-to-peer networks (e.g., ad hoc peer-to-peer networks).

The computing system can include users and servers. A user and server are generally remote from each other and typically interact through a communication network. The relationship of user and server arises by virtue of computer programs running on the respective computers and having a user-server relationship to each other. In some embodiments, a server transmits data (e.g., an HTML page) to a user device (e.g., for purposes of displaying data to and receiving user input from a user interacting with the user device). Data generated at the user device (e.g., a result of the user interaction) can be received from the user device at the server.

While this specification contains many specific implementation details, these should not be construed as limitations on the scope of any features or of what may be claimed, but rather as descriptions of features specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

What is claimed is:

1. A method comprising:

obtaining a gamma value for a pixel of an image to be shown on a display;

determining a base gamma value based on a base lookup table that corresponds to a base display condition;

determining a delta gamma value based on a delta lookup table that corresponds to a current display condition for the pixel, wherein determining the delta gamma value based on the delta lookup table that corresponds to the current display condition for the pixel comprises:

determining the current display condition;

determining a set of delta gamma values based on delta lookup tables that each correspond to a different display condition; and selecting the delta gamma value from the set of delta gamma values based on the current display condition;

determining a remapped gamma value for the pixel based on a combination of the base gamma value and the delta gamma value; and providing the remapped gamma value to be shown on the display.

2. The method of claim 1, wherein determining the remapped gamma value for the pixel based on the combination of the base gamma value and the delta gamma value comprises:

determining a sum of the base gamma value and the delta gamma value as the remapped value.

3. The method of claim 1, wherein selecting the delta gamma value from the set of delta gamma values based on the current display condition comprises:

providing a selection signal to a multiplexor that receives the delta gamma values as inputs and uses the selection signal to select the delta gamma value as an output.

4. The method of claim 1, wherein determining the current display condition comprises:

determining a refresh rate of the display and a display brightness value of the display, wherein the delta lookup tables each correspond to a different combination of refresh rate of the display and display brightness value of the display.

5. The method of claim 1, wherein the base gamma value is represented by more bits than the delta gamma value.

6. The method of claim 5, wherein the base gamma value is represented by ten bits and the delta gamma value is represented by five bits.

7. A method comprising:

obtaining a gamma value for a pixel of an image to be shown on a display;

determining a base gamma value based on a base lookup table that corresponds to a base display condition;

determining a delta gamma value based on a delta lookup table that corresponds to a current display condition for the pixel, wherein the base gamma value is represented by more bits than the delta gamma value, wherein the base lookup table represents outputs of base gamma values with more bits than the delta lookup table represents outputs of delta gamma values;

determining a remapped gamma value for the pixel based on a combination of the base gamma value and the delta gamma value; and providing the remapped gamma value to be shown on the display.

8. A system that includes circuitry configured to perform operations of:

obtaining a gamma value for a pixel of an image to be shown on a display;

determining a base gamma value based on a base lookup table that corresponds to a base display condition;

determining a delta gamma value based on a delta lookup table that corresponds to a current display condition for the pixel, wherein determining the delta gamma value based on the delta lookup table that corresponds to the current display condition for the pixel comprises:

determining the current display condition;

determining a set of delta gamma values based on delta lookup tables that each correspond to a different display condition; and selecting the delta gamma value from the set of delta gamma values based on the current display condition;

determining a remapped gamma value for the pixel based on a combination of the base gamma value and the delta gamma value; and providing the remapped gamma value to be shown on the display.

9. The system of claim 8, wherein determining the remapped gamma value for the pixel based on the combination of the base gamma value and the delta gamma value comprises:

determining a sum of the base gamma value and the delta gamma value as the remapped value.

10. The system of claim 8, wherein selecting the delta gamma value from the set of delta gamma values based on the current display condition comprises:

providing a selection signal to a multiplexor that receives the delta gamma values as inputs and uses the selection signal to select the delta gamma value as an output.

11. The system of claim 8, wherein determining the current display condition comprises:

determining a refresh rate of the display and display brightness value of the display, wherein the delta lookup tables each correspond to a different combination of refresh rate of the display and display brightness value of the display.

12. The system of claim 8, wherein the base gamma value is represented by more bits than the delta gamma value.

13. The system of claim 12, wherein the base gamma value is represented by ten bits and the delta gamma value is represented by five bits.

14. A system that includes circuitry configured to perform operations of:

obtaining a gamma value for a pixel of an image to be shown on a display;

determining a base gamma value based on a base lookup table that corresponds to a base display condition;

determining a delta gamma value based on a delta lookup table that corresponds to a current display condition for the pixel, wherein the base gamma value is represented by more bits than the delta gamma value, wherein in the base lookup table represents outputs of base gamma values with more bits than the delta lookup table represents outputs of delta gamma values;

determining a remapped gamma value for the pixel based on a combination of the base gamma value and the delta gamma value; and providing the remapped gamma value to be shown on the display.

15. A method comprising:

obtaining a gamma value for a pixel of an image to be shown on a display;

determining a base gamma value based on a base lookup table that corresponds to a base display condition, the base display condition being based on a combination of a first display refresh rate and a first display brightness value of the display;

determining a delta gamma value based on a delta lookup table that corresponds to a current display condition for the pixel, the current display condition determined based on a current refresh rate and a current display brightness value of the display, the delta lookup table representing a difference from the base lookup table for a combination of the current refresh rate and the current display brightness value;

determining a remapped gamma value for the pixel based on a combination of the base gamma value and the delta gamma value; and providing the remapped gamma value to be shown on the display.

16. A system that includes circuitry configured to perform operations of:

obtaining a gamma value for a pixel of an image to be shown on a display;

determining a base gamma value based on a base lookup table that corresponds to a base display condition, the base display condition being based on a combination of a first display refresh rate and a first display brightness value of the display;

determining a delta gamma value based on a delta lookup table that corresponds to a current display condition for the pixel, the current display condition determined based on a current refresh rate and a current display brightness value of the display, the delta lookup table representing a difference from the base lookup table for a combination of the current refresh rate and the current display brightness value;

determining a remapped gamma value for the pixel based on a combination of the base gamma value and the delta gamma value; and providing the remapped gamma value to be shown on the display.

* * * * *